United States Patent [19]

Yates et al.

[11] Patent Number: 4,881,470

[45] Date of Patent: Nov. 21, 1989

[54] GONDOLA CAR HAVING FRAMELESS RADIAL TRUCK

[75] Inventors: Donald B. Yates, Birmingham, Ala.; Phillip G. Przbylinski, Shererville, Ind.

[73] Assignee: Trinity Industries, Inc., Dallas, Tex.

[21] Appl. No.: 47,979

[22] Filed: May 7, 1987

[51] Int. Cl.[4] ..... B61F 5/38

[52] U.S. Cl. ..... 105/165; 105/406.1

[58] Field of Search ..... 105/165, 161, 199.1, 105/199.5, 211–214, 404, 413, 414, 416, 418, 419, 421, 406.1

[56] References Cited

U.S. PATENT DOCUMENTS

| | | | |
|---|---|---|---|
| 402,743 | 5/1889 | King | 105/165 |
| 922,103 | 5/1909 | Dinkey | 105/414 X |
| 1,475,187 | 11/1923 | Kadel | 105/406.1 |
| 2,184,337 | 12/1939 | Durvea | 105/226 |
| 2,907,283 | 10/1959 | Markestein et al. | 105/199.5 |
| 3,527,171 | 9/1970 | Stark | 105/416 X |
| 3,719,155 | 3/1973 | O'Leary | 105/421 X |
| 3,841,236 | 10/1974 | Hammonds et al. | 105/364 |
| 4,236,459 | 12/1980 | Teoli | 105/406.1 |
| 4,589,348 | 5/1986 | Holabeck et al. | 105/406.1 X |
| 4,637,320 | 1/1987 | Paton et al. | 105/406.1 |
| 4,676,172 | 6/1987 | Bullock | 105/168 |

*Primary Examiner*—Robert B. Reeves
*Assistant Examiner*—F. Williams, Jr.
*Attorney, Agent, or Firm*—John J. Kowalik

[57] ABSTRACT

A gondola-type railway car has an end structure supported on a frameless radial truck. The end structure includes a center sill and a bottom closure member. Side sill members are connected to the sides of the bottom closure member. The undersurface of the bottom closure member has eight wedge pockets thereon with reinforcement attached thereto for engaging eight support pads on the truck. The pads and the wedge pockets are arranged in four longitudinally-spaced pairs of laterally spaced pads. The bottom closure member has a reinforcement structure on its upper surface for transferring the weight of the car to the truck. The reinforcement structure includes three transverse reinforcement channels above the three inner pairs of wedge pockets. A pair of longitudinally extending channel members extend from above the outer wedge pockets to engage the outermost transverse beam to tie the outer wedge pockets into the car body structure. Gussets in the outermost transverse beam reinforce it to receive loads from the channel members. Gussets are provided in the channel members for full support of the outermost wedge pockets.

9 Claims, 3 Drawing Sheets

GONDOLA CAR HAVING FRAMELESS RADIAL TRUCK

BACKGROUND OF THE INVENTION

Related Applications

This application is related to the U.S. Pat. Application having Ser. No. 597,125 filed on April 5, 1984 now U.S. Pat. No. 4690072 by Herbert S. Wille, et al. and entitled "BOLSTER FOR A RAILWAY CAR".

Field of the Invention

This invention relates to railway cars, and more particularly to gondola railway cars having a frameless type radial truck.

Description of the Prior Art

The usual practice in a prior art has been to support gondola car bodies with a four-wheeled truck at each end of the car. The truck normally comprised a frame supporting two axles each having two wheels. A pin at approximately the center of the truck extended upwardly, and the gondola car body had a reinforced receiving opening therein which admitted the truck pivot pin for support of the car body on the truck. The structure of the car body was designed to transmit almost all of the vertical load of the car body's weight and the weight of the cargo to the truck at one particular point, i.e., the structure around the truck pivot pin. Recently, frameless radial trucks have been devised which do not have a frame restricting movement of the axles, but include a pair of axles with wheels thereon supporting four castings. Each casting supports a pair of resilient connection structures in the area of the wheels. The resilient structures supportingly engage the car body. The engagement results in vertical loads being transferred in different locations in the car body from those locations usual in the prior art. The older structures of gondola cars configured for use with frame trucks having a central pivot pin are ill equipped to support loads in these locations.

SUMMARY OF THE INVENTION

A gondola type railway car has a truck which includes a laterally extending axle with a pair of wheels supported thereon for rollingly supporting the truck on rails. The truck has two longitudinally spaced pairs of laterally spaced support means thereon. The railway car has a car body which includes an end structure supported on the truck. The end structure includes a bottom closure member having an upper surface and a lower surface and a center sill connected with the bottom closure member. Receiving means are supported on the lower surface of the bottom closure members and engage the support means for supporting the car body on the truck.

The car body has a plurality of laterally extending longitudinally spaced truck support members fixedly connected with the upper surface of the bottom closure member. Each of the truck support members is substantially vertically above a respective pair of support means to reinforce the bottom closure member to support the car body on the truck.

The car body includes a center sill and side sill members fixedly connected with the lateral sides of the bottom closure member whereby the bottom closure member acts as a shear plate member to beam longitudinal loads from the center sill through the shear plate member to the side sill members. The truck support members are connected at their lateral ends to side post members supported on the side sill members. The side post members receive loads from the side walls of the car body and transfer loads through the support member to the receiving means and onto the support means of the truck. Because the truck support members and the side post members are supported within the car above the shear plate member, the side sill members can extend substantially continuously below the side post members, making them stronger to bear longitudinal loads without having strength detractive cross-sectional welds which would otherwise be necessary.

Reinforcement structure is also provided above the outward two pairs of support means on the radial truck in the form of a support beam fixedly connected with the upper surface of the bottom closure member and extending longitudinally thereon above one of the first pair of support means on the truck and one of the second pair of support means for reinforcing the car body to be supported on the support means.

Other purposes and advantages of this invention will be expressed hereinafter, and the scope of the invention will be articulated in the claims.

DESCRIPTION OF THE PREFERRED EMBODIMENT

Figure 1:
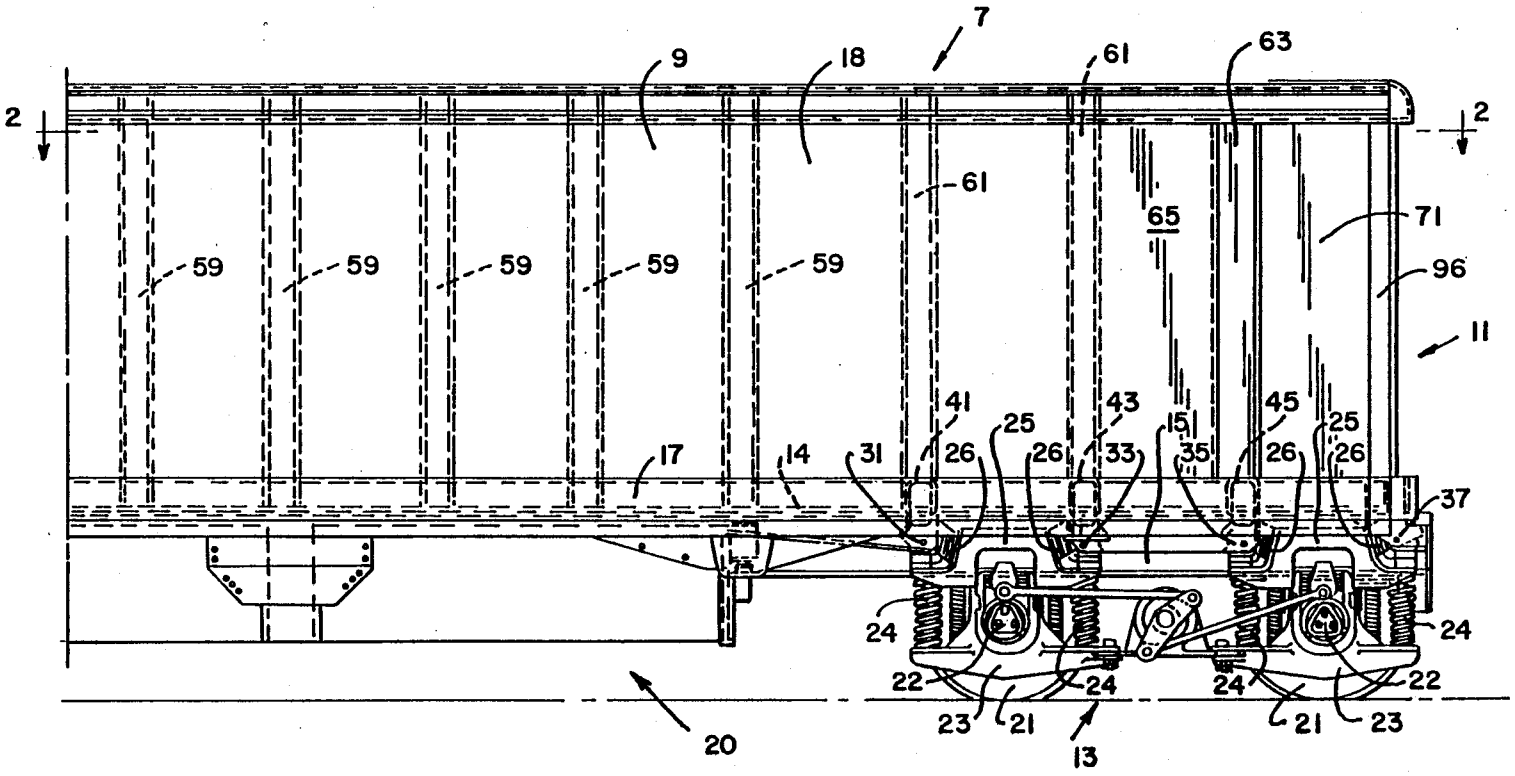
FIG. 1 is an elevational view of one end of a gondola car having the structure of this invention.

Referring to FIG. 1, a railway car generally indicated at 7 includes a car body 9 having an end structure generally designated at 11. The end structure 11 is supported on a frameless radial truck generally indicated at 13. One end of the car 7 is shown in FIG. 1 and it will be understood that a substantially identical arrangement is provided at the opposite longitudinal end of the railway car 7.

The end structure 11 of car body 9 includes a bottom closure member 14 fixedly connected with a stub center sill 15 by fastening means in the form of bolts 16. The bottom closure member 14 has two laterally opposite side portions each fixedly connected as by welding to side sill members 17 which extend along lateral sides of car body 9.

As a result, longitudinal loads applied to the stub sill 15, as by a coupler connecting to other railway cars, are transferred to the bottom closure member 14 which serves as a shear plate member to beam the loads laterally outwardly to the side sill members 17. Side sill members 17 carry longitudinal draft and buff loads and transfer these loads to the end structure at the opposite longitudinal end of the car 7. Side wall structures 18 extend upwardly from the side sill members 17, and an end wall 19 extends upwardly adjacent the longitudinally outward end of the bottom closure member 14 to form a cargo-carrying interior space in the car body 9. A depressed well section generally indicated at 20 is supported between the end structures 11 of the car body 9 to provide additional cargo space therein.

Figure 3:
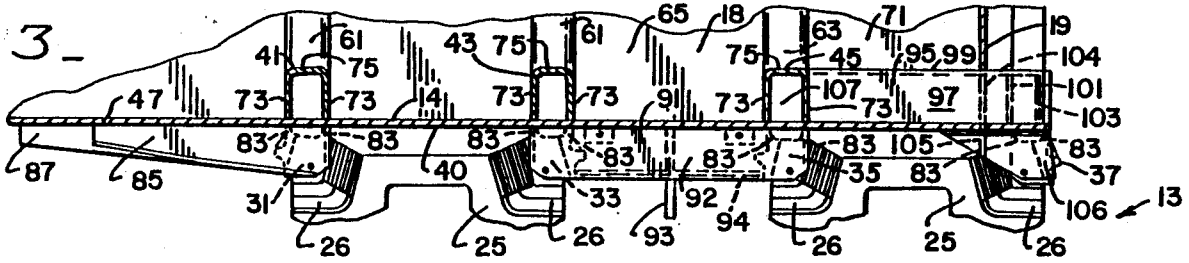
FIG. 3 is a sectional view taken along line 3—3 of FIGURE 2 and shows the wedge pocket arrangement supporting the car body on the frameless radial truck.

The frameless radial truck 13 supporting end structure 11 includes four wheels 21. Wheels 21 are supported on axles extending into journal boxes 22 which are connected with lower castings 23. Lower castings 23 have spring arrangements 24 supported thereon which springingly support upper castings 25 thereon. As best shown in FIG. 3, each upper casting 25 supports a pair of longitudinally spaced resilient support means 26. The car body 9 has receiving means in the form of a plurality of pairs of laterally spaced wedge pockets 31,33,35 and 37. Wedge pockets 31,33,35 and 37 each rest upon and securingly receive a respective resilient support means 26 for supporting the end structure 11 on the truck 13.

As best shown in FIG. 3, the wedge pocket arrangements 31,33,35 and 37 are secured to the undersurface 40 of bottom closure member 14. One of the upper castings 25 has the support means 26 thereon engaging wedge pockets 31 and 33, and the other of the upper castings 25 has the support means 26 thereon engaging wedge pockets 35 and 37.

The weight of the railway car body 9 and the cargo contents of the car are supported on each end of the car on the four pairs of laterally spaced wedge pockets 31,33,35 and 37. The structure of the car body 9 transmits loads to these eight locations at each end of the car 7 primarily from the side wall structures 18 which carry a large portion of the weight of the car and its cargo. For transferring the vertical loads laterally inwardly from the side wall structure 18 to the support means 26, the car body 9 is equipped with three transversely extending truck support members 41,43 and 45 affixed to the upper surface 47 of the bottom closure member 14. Truck support members 41,43, and 45 extend transversely across the railway car body 9 between the side sill members 17 substantially directly above respective pairs of wedge pockets 31,33 and 35. The side wall structures 18 include a plurality of vertical side post members 59,61, and 63 extending upwardly from the side sill members 17. Side sheets 65 are fixedly attached to the laterally outward portions of post members 59,61 and 63 and to the side sill members 17.

The truck support members 41,43 and 45 each have two opposite lateral ends 51 and 53. The lateral ends 51 and 53 of each of the two longitudinally inward truck support members 41 and 43 are fixedly connected with vertical side post members 61. Truck support member 45 has lateral ends 51 and 53 connected with side post members 63. Side post members 63 are configured with a curved outer surface contiguous with the side wall sheet 65 and are connected to respective inwardly offset side wall portions 71. This provides an inset portion adjacent the end of the car in which safety appliances may be installed for operator mounting and dismounting the railway car 7. As best shown in FIG. 3, each of the truck support members 41,43, and 45 is a generally channel-shaped structure having a pair of longitudinally spaced, laterally extending vertical wall portions 73 and a horizontally extending top wall portion 75 formed integral with the upper ends of the vertical wall portions 73. The lower ends of the vertical wall portions 73 are fixedly attached as by welding to bottom closure member 14 and form therewith transverse tubular beam structures fixedly connected with the side post members 61 and 63.

Each of the wedge pockets 31,33,35 and 37 has two upwardly disposed engagement portions 83 supportingly engaging the undersurface 40 of the bottom closure member 14. The wall portions 73 of each of the truck support members 41,43, and 45 are substantially vertically aligned with the engagement portions 83 of the associated wedge pocket to transfer loads to the engagement portions 83 efficiently.

Figure 2:
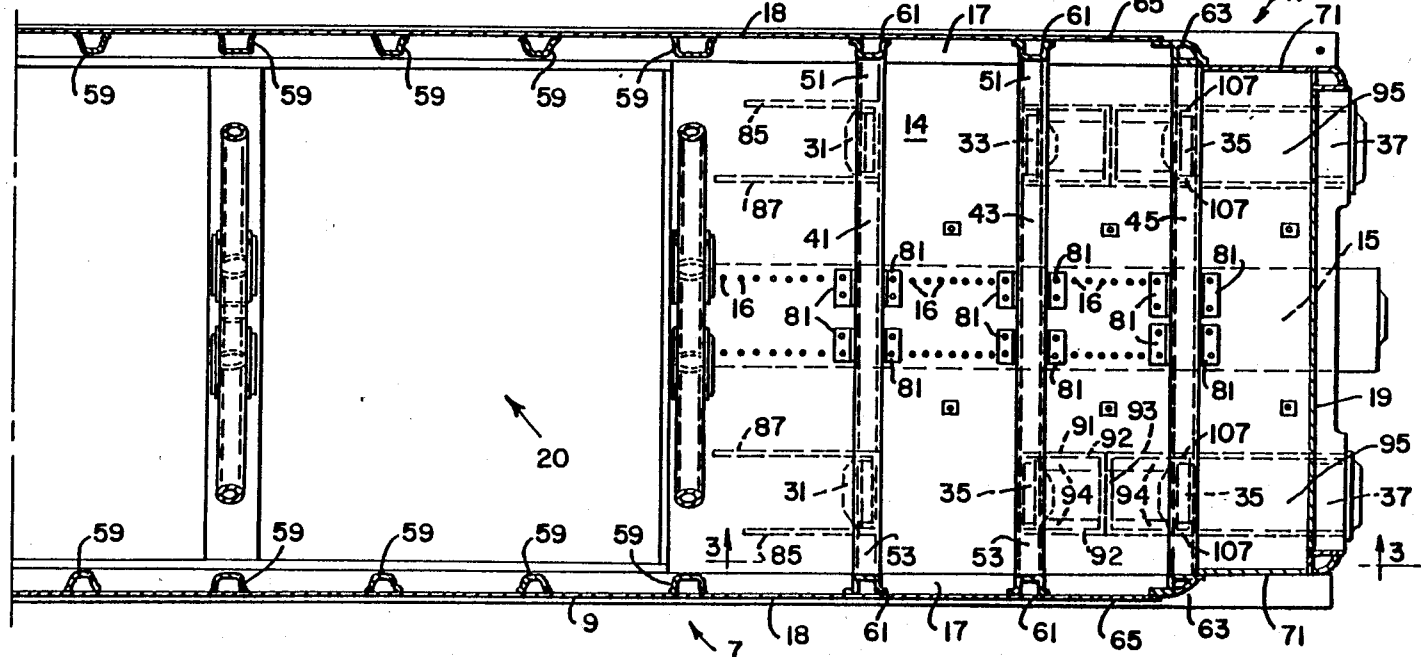
FIG. 2 is a section view taken along line 2—2 of FIG. 1.
Figure 4:
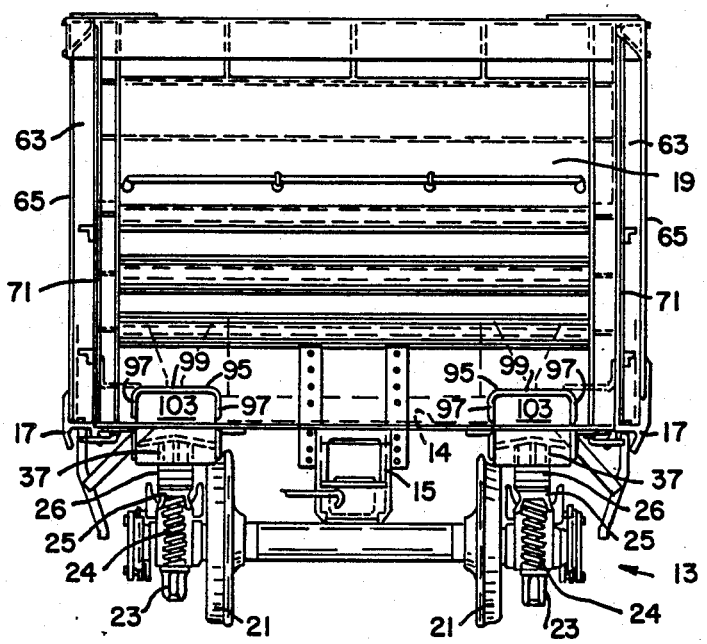
FIG. 4 is an end view of the gondola car.

As best visible in FIG. 2, the side post members 61 are also channel-shaped members fixedly connected with the associated side sheet 65 to form vertical tubular beam structures. The side post members 61 are formed of channel which is similar in width to that of the truck support members 41 and 43 so that the substantially parallel wall portions of the side post members 61 align with the vertical wall portions 73 of truck support members 43 and 45 to provide storing fixed connection therebetween. Side post members 63 are also vertical tubular beam structures of approximately the same width as truck support member 45 for secure attachment thereto.

One advantage of this arrangement wherein the truck support members 41,43 and 45 are connected to the upper surface 47 of bottom closure member 14 is that it permits direct connection of the side post members 61 and 63 to the truck support members 41,43, and 45 for efficient load transfer therebetween while allowing the bottom closure member 14 and the side sill members 17 to extend continuously therebelow. If the truck support members 41,43, and 45 were on the lower surface of bottom closure member 14, direct connection to the side post members 61 and 63 would entail cutting through the bottom closure member 14 or the side sill members 17 with resultant strength detractive effect on the shear plate structure or the side sill members 17. The structure of this invention avoids this strength detractive problem.

Another advantage of the disclosed structure is that the ends 51 and 53 abut lower ends of side post members 61 and 63 so that the welded connection between the side post members and the truck support member transfers vertical loads therebetween as a shear load. Welds are generally strongest to bear loads in shear as opposed to tension or compression, so that resulting structure is more efficient.

The laterally inward transfer of vertical load from the side post members 61 and 63 to the wedge pockets 31,33, and 35 produces a bending moment in each of the truck support members 41,43 and 45. The bending movement results in a tendency of the truck support members 41,43 and 45 to flex upwardly at the middle of the car, causing the support beams 41,43 and 45 to tend to separate from the upper surface 47 of the bottom closure member 14. To prevent this separation, the truck support beams 41,43 and 45 are secured to the bottom closure member 14 by securement means in the form of angle brackets 81 which are fixedly attached to the truck support members 41,43, and 45 and to the bottom closure member 14 substantially directly above the center sill 15 and in the general area of bolts 16 to structurally tie in angle brackets 81 to the center sill 15 for full support of the upwardly directed loads.

In addition to the vertical loads created by the weight of the car 7 and its cargo, longitudinal loads are also applied to the wedge pockets 31,33,35, and 37, and structure for reinforcement of the wedge pockets 31,33,35, and 37 is provided as best shown in FIG. 3.

The longitudinal loads applied to wedge pocket 31 are primarily directed longitudinally inwardly with respect to the car 7, and are supported by gussets 85 and 87 which are connected with the lateral sides of wedge pocket 31 and the bottom surface 40 of the bottom closure member 14 and extends longitudinally inward therefrom.

The longitudinal loads on wedge pocket 33 are primarily directed longitudinally outwardly with respect to the car, and the longitudinal loads on wedge pocket 35 are primarily directed inwardly with respect to the car. To support these loads, a connecting structure 91 extends between wedge pocket 33 and wedge pocket 35. Structure 91 is affixed to the bottom surface 40 of the bottom closure member 14, to transfer the loads on the wedge pocket 33 and 35 into the bottom closure member 14.

Figure 5:
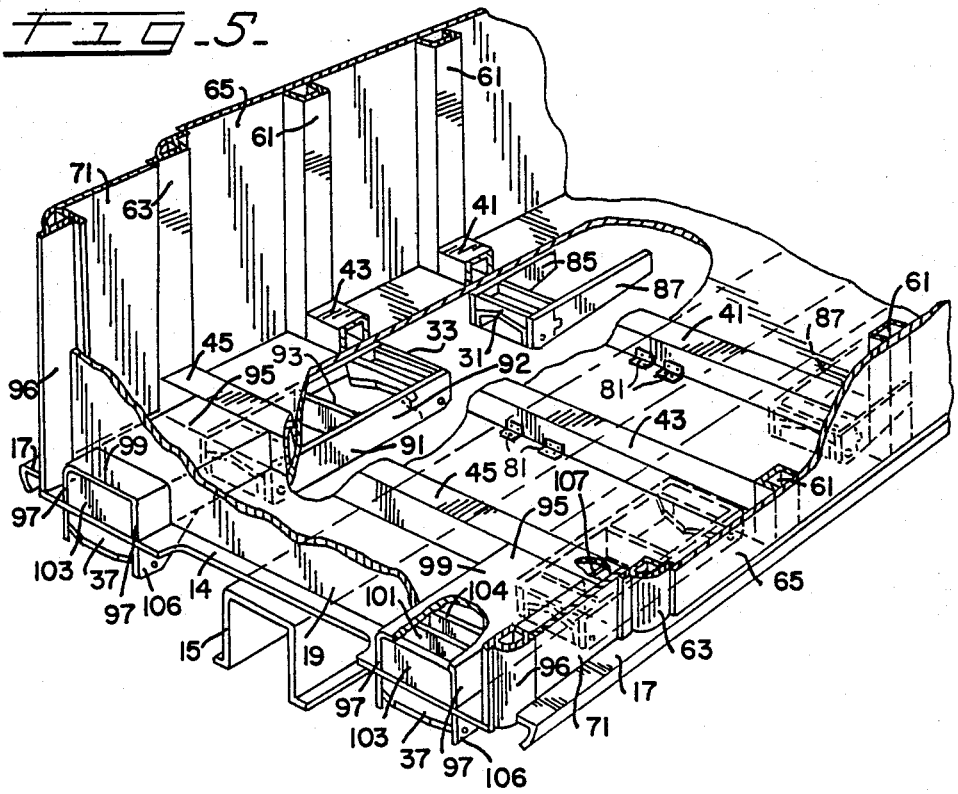
FIG. 5 is a partially cut away perspective view of the end structure of the gondola car.

As best shown in FIGS. 2,3, and 5, connecting structure 91 comprises a pair of laterally spaced wall members 92 each fixedly connected with a respective side of each of the wedge pockets 33 and 35. A reinforcement plate 93 extends generally laterally and vertically between the wall members 92 in a plane which is also the centerline of the truck. Flange portions 94 are connected with the inside lower edge of each of the wall members 92 to reinforce the connecting structure 91.

Wedge pocket 37 is supported adjacent the end sill 96 of the car and is longitudinally outwardly spaced from the end wall 19 of the car. The generally outward location of wedge pocket 37 requires structural support different from that of the other wedge pockets 31,33, and 35. A large portion of the structural support for wedge pocket 37 is provided by pocket support beam 95 which is secured to the upper surface 47 of the bottom closure member 14.

Pocket support beam 95 extends through end wall 19 and substantially directly above wedge pocket 37 at the end of the car 7. Pocket support beam 95 extends longitudinally inward from the end of the car 7 to engage truck support member 45. As a result, vertical loads transferred into truck support member 45 from side post member 63 are partly beamed outward through pocket support beam 95 to wedge pocket 37, and then to the truck 13. Longitudinal loads applied to wedge pocket 37 are supported by transfer through pocket support beam 95 to truck support member 45. Vertical loads are also transferred from corner posts 96 through end wall 19 to wedge pockets 37.

As best shown in FIG. 5, each pocket support beam comprises a channel-shaped member having longitudinally extending laterally spaced vertical walls 97 fixedly connected to the upper surface 47 of bottom closure member 14 and a horizontal top wall 199 formed integral with the upper ends of the vertical walls 97. The walls 97 and 99 form a tubular beam structure with the bottom closure member 14 for transmitting loads between wedge pocket 31 and truck support member 45.

Gussets 101 and 103 are secured within each of the pocket support beams 95. The gussets 101 and 103 are each substantially vertically aligned with a respective engagement portion 83 of wedge pocket 37. Gussets 101 and 103 engage walls 97 and 99 and bottom closure member 14 for reinforcing the support beams 94 to support wedge pockets 37.

As best visible in FIG. 3, additional gussets 104 and 105 are substantially aligned vertically with end wall 19 to structurally tie in wedge pocket 37 into the end wall 19. Gusset 104 engages the bottom closure member 14 and the three walls 97 and 99 of pocket support beam 95. Gusset 105 is positioned between a pair of reinforcement walls 106 each fixedly connected with a respective lateral side of wedge pocket 37 to transmit loads therein to the bottom closure member 14, the beam 95, and the end wall 19.

To support forces transmitted between pocket support beams 95 and truck support member 45, truck support member 45 is reinforced by gussets 107 supported between the wall portions 73 of the truck support member 45. The gussets engage the bottom closure member 14 and the wall portions 73 and 75 of support member 45 in substantially alignment longitudinally with the walls 97 of pocket support beam 95. The results in effective load transfer between support member 45 and pocket support beam 95, permitting vertical loads in the side post member 63 to be transferred laterally inwardly through truck support member 45 and then longitudinally outwardly through pocket support beam 95 to be supported on wedge pocket 37 and the support means 26 on the truck 13. The moments of force resulting from the longitudinal displacement of the load are borne partly by support beams 95 connecting to bottom closure member 14, and partly by truck support member 45 acting as a torque box in combination with the bottom closure member 14 for bearing the moment into the rest of the car body. Gussets 107 also strength truck support member 45 to receive the moments from supports beams 95.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A railway car comprising:

a truck including a first laterally extending axle having a first pair of wheels supported thereon for rolling support on a pair of rails; said truck having first and second longitudinally spaced pairs of laterally spaced support means thereon; a car body having an end structure supported on the truck; said end structure including:

a bottom closure member having an upper surface and a lower surface;

a center sill connected with the bottom closure member;

receiving means on the lower surface of the bottom closure member and engaging said support means for supporting said car body on the truck;

first and second laterally extending longitudinally spaced truck support members fixedly connected with the the upper surface of the bottom closure member, each of said truck support members being substantially vertically above a respective pair of support means for reinforcing the bottom closure member to support the car body on the truck;

said truck having a second laterally extending axle thereon spaced longitudinally from the first axle and having a second pair of wheels thereon, said truck having a third pair of laterally spaced support means spaced longitudinally outward from said first and second pairs of support means; and said receiving means engaging said third pair of support means for supporting said car body thereon;

a third truck support member fixedly connected with the upper surface of the bottom closure member, said third truck support member being substantially vertically above the third pair of support members for reinforcing the bottom closure member to support the car body on the truck;

said truck having a fourth pair of laterally spaced support means spaced longitudinally outward from the first, second, and third pairs of support means, said receiving means including a pair of laterally spaced engagement means each engaging respective support means of the fourth pair of support means.

2. The invention according to claim 1 and a first generally longitudinally extending support beam means fixedly connected with the upper surface of the bottom closure member, said support beam means being positioned substantially vertically above one of the engagement means and extending longitudinally therefrom to be fixedly engaged with said third truck support member for strengthening the support for said one of the engagement means.

3. The invention according to claim 2 and said support beam means comprising a channel shaped member forming a generally tubular beam with the bottom closure member for supporting said one of the engagement means.

4. A railway car comprising:

a truck including a first laterally extending axle having a first pair of wheels supported thereon for rolling support on a pair of rails; said truck having first and second longitudinally spaced pairs of laterally spaced support means thereon; a car body having an end structure supported on the truck; said end structure including:

a bottom closure member having an upper surface and a lower surface;

a center sill connected with the bottom closure member;

receiving means on the lower surface of the bottom closure member and engaging said support means for supporting said car body on the truck;

first and second laterally extending longitudinally spaced truck support members fixedly connected with the the upper surface of the bottom closure member, each of said truck support members being substantially vertically above a respective pair of support means for reinforcing the bottom closure member to support the car body on the truck. said receiving means comprising four wedge pocket means, each of said wedge pocket means receivingly engaging a respective support means on the truck, reinforcement means being connected with one of the wedge pocket means and extending longitudinally inwardly therefrom, said reinforcement means being affixed to the lower surface of the bottom closure member for reinforcing said one of the wedge pocket means to receive longitudinal loads from the support means.

5. A railway car having lateral sides and comprising:

a truck including a first laterally extending axle having a first pair of wheels supported thereon for rolling support on a pair of rails; said truck having first and second longitudinally spaced pairs of laterally spaced support means thereon; a car body having an end structure supported on the truck; said end structure including:

a bottom closure member having an upper surface and a lower surface;

a center sill connected with the bottom closure member;

receiving means on the lower surface of the bottom closure member and engaging said support means for supporting said car body on the truck;

first and second laterally extending longitudinally spaced truck support members fixedly connected with the the upper surface of the bottom closure member, each of said truck support members being substantially vertically above a respective pair of support means for reinforcing the bottom closure member to support the car body on the truck and said receiving means and support means being located in an area intermediate said center sill and the lateral sides of the car, said truck having a second laterally extending axle thereon spaced longitudinally from the first axle and having a second pair of wheels thereon.

said truck having a third pair of laterally spaced support means spaced longitudinally outward from said first an second pairs of support means; and said receiving means engaging said third pair of support means or supporting said car body thereon.

said receiving means including first and second pairs of wedge pocket means engaging said second and third pair of support means respectively, and reinforcing means connected to one of each said first and second pairs of wedge pocket means for reinforcing said wedge pocket means to bear longitudinal loads from the truck.

6. A railway car comprising:

a truck including a first laterally extending axle having a first pair of wheels supported thereon for rollingly support the truck on a pair of rails;

said truck having first and second longitudinally spaced support means thereon; said second support means being positioned longitudinally outwardly of first support means; a car body having an end structure on the truck; said end structure including:

a bottom closure member having an upper surface and a lower surface;

a center sill connected with the lower surface of the bottom closure member;

pocket means on the lower surface of the bottom closure member and engaging the first support means for supporting the truck;

pocket means connected with the lower surface of the bottom closure member and engaging the second support means for supporting the car body on the truck;

lateral support beam members fixedly connected with the upper surface of the bottom closure member and extending generally longitudinally thereon respectively above the first and second support means for reinforcing the car body to be supported on the support means, and pocket support beams bracing said pocket and other pocket means and located at the same level as said lateral support beam members.

7. The invention according to claim 6 and a third truck support member extending generally laterally with respect to the car body substantially directly above the first support means.

8. The invention according to claim 7 and said truck support member comprising a pair of longitudinally spaced generally vertical walls extending generally laterally and having lower end portions fixedly engaged with the bottom closure member; and a generally horizontal top wall connected with and extending between the generally vertical walls and forming with the vertical walls and the bottom closure member a transverse beam on the railway car body.

9. The invention according to claim 8 and gusset means supported between and engaging said vertical walls, said horizontal wall, and said bottom closure member of said third truck support member for reinforcing said third support member to receive loads from said support beam member.

* * * * *